US005807213A

United States Patent [19]

Poncini

[11] Patent Number: 5,807,213

[45] Date of Patent: Sep. 15, 1998

[54] LOWER BODY EXERCISE APPARATUS

[76] Inventor: Richard Poncini, 2902 Alameda Ave., Half Moon Bay, Calif. 94019

[21] Appl. No.: 718,996

[22] Filed: Sep. 24, 1996

Related U.S. Application Data

[63] Continuation-in-part of Ser. No. 271,254, Jul. 7, 1994, Pat. No. 5,558,606, which is a continuation of Ser. No. 41,089, Apr. 1, 1993, abandoned, which is a continuation-in-part of Ser. No. 11,665, Jan. 29, 1993, abandoned.

[51] Int. Cl.[6] ..... A63B 23/04

[52] U.S. Cl. ..... 482/91; 482/79; 482/907

[58] Field of Search ..... 482/52, 79, 91, 482/142, 145, 907, 148

[56] References Cited

U.S. PATENT DOCUMENTS

| | | | |
|---|---|---|---|
| 1,664,664 | 4/1928 | Crum | 482/79 |
| 3,297,320 | 1/1967 | Benedetto | 482/148 |
| 3,598,404 | 8/1971 | Bowman | 482/80 |

OTHER PUBLICATIONS

Raw Power publication, Exercise equipment sales brochure, Jan. 1994.

Schwarzenegger, Arnold. *Encyclopedia of Modern Bodybuilding*. 1985. New York. Simon & Schuster p. 481.

*Primary Examiner*—Richard J. Apley
*Assistant Examiner*—John Mulcahy
*Attorney, Agent, or Firm*—Flehr Hohbach Test Albritton & Herbert LLP

[57] ABSTRACT

A lower body exercise apparatus includes a plurality of supports, each support configured to be positioned on a horizontal surface and including a base having an inclined surface. In one embodiment of the invention, the inclined surface forms an angle between approximately 20° and 55° from horizontal. In one aspect of the invention, the plurality of supports includes two supports positioned at a distance from one another and having an angle relative to one another. The user can perform exercises on the two supports to exercise the lower body and to improve agility. In another aspect of the invention, the plurality of supports includes a first set of two supports positioned at a distance from one another and having the inclined surfaces facing one another, and a second set of two supports positioned at a distance from one another and having the inclined surfaces facing one another, and where the supports are arranged substantially in a rectangle on a horizontal surface. The user can perform exercises on the four supports to exercise the lower body and to improve agility.

6 Claims, 8 Drawing Sheets

LOWER BODY EXERCISE APPARATUS

REFERENCE TO RELATED APPLICATIONS

This is a continuation-in-part of U.S. Ser. No. 08/271,254 filed Jul. 7, 1994, now U.S. Pat. No. 5,558,606, which is a continuation of U.S. Ser. No. 08/041,089 filed Apr. 1, 1993, now abandoned, which is a continuation-in-part of U.S. Ser. No. 08/011,665 filed Jan. 29, 1993, now abandoned. U.S. Pat. No. 5,558,606 is incorporated herein by reference.

FIELD

This invention relates generally to exercise equipment and more specifically to an apparatus for exercising lower body muscles.

BACKGROUND

A variety of conventional exercises are known for working out lower body muscles. For example, one type of leg muscle exercise involves positioning the feet on the floor or other flat surface and then raising the heels above the surface and then lowering them. This exercises the leg muscles through a range of contraction. A second type of leg muscle exercise involves positioning the feet on a step or other type of ledge, lowering the heels beneath the level of the ledge and then raising them. This stretches the leg muscles and exercises the leg muscles through a range of motion.

These techniques provide moderate levels of exercise for the leg muscles, but a more efficient and thorough technique permitting greater contraction of the leg muscles and greater exercise of the leg muscles is preferred. Additionally, other exercises related to the lower body and legs are also desired including exercises that strengthen the leg and ankle muscles and improve agility.

SUMMARY

The invention provides an improved apparatus for exercising the lower body and so as to efficiently and thoroughly exercise the leg muscles. A lower body exercise apparatus according to an embodiment of the invention includes a pair of bases each having an inclined surface for each supporting one of a user's feet. For example, the inclined surface angle ranges from approximately 20° to 55° from horizontal, and preferably approximately 35° from horizontal. Moreover, the bases can be positioned at a distance from one another and an angle from one another. For example, the bases can be positioned at approximately 6 to 24 inches from one another and with an angle of approximately 0° to 150° from one another.

According to one aspect of the invention, a user can position their feet against the inclined surfaces with the toes downward and the portion of the feet from the ball of the foot to the heel of the foot being against the inclined surfaces. With the feet positioned in this manner the user may then perform squat exercises, either with or without weights, to exercise the leg muscles. According to another aspect of the invention, the user can position their feet with their heels on the floor, or other horizontal support surface, and with their toes and front portions of their feet oriented upward against the inclined surfaces. With the feet positioned in this manner, stretching exercises can be performed either with or without weights. According to yet another aspect of the invention, the device can be angled with respect to one another to accommodate the user and provide a comfortable exercise angle.

Another embodiment of the invention includes positioning the bases opposite to one another so that the user can shift weight from one base to the other. This permits the user to exercise the leg and ankle muscles and to practice agility exercises. An aspect to this embodiment includes two pairs of bases that form a square with an internal area bounded by the inclined surfaces. This permits the user to exercise the leg and ankle muscles and to practice advanced agility exercises.

A further understanding of the nature and advantages of the invention may be realized by reference to the remaining portions of the specification and the drawings.

DESCRIPTION OF THE FIGURES

Additional objects and features of the invention will be more readily apparent from the following detailed description and the pending claims when taken in conjunction with the drawings, in which:

DETAILED DESCRIPTION

Figure 1:
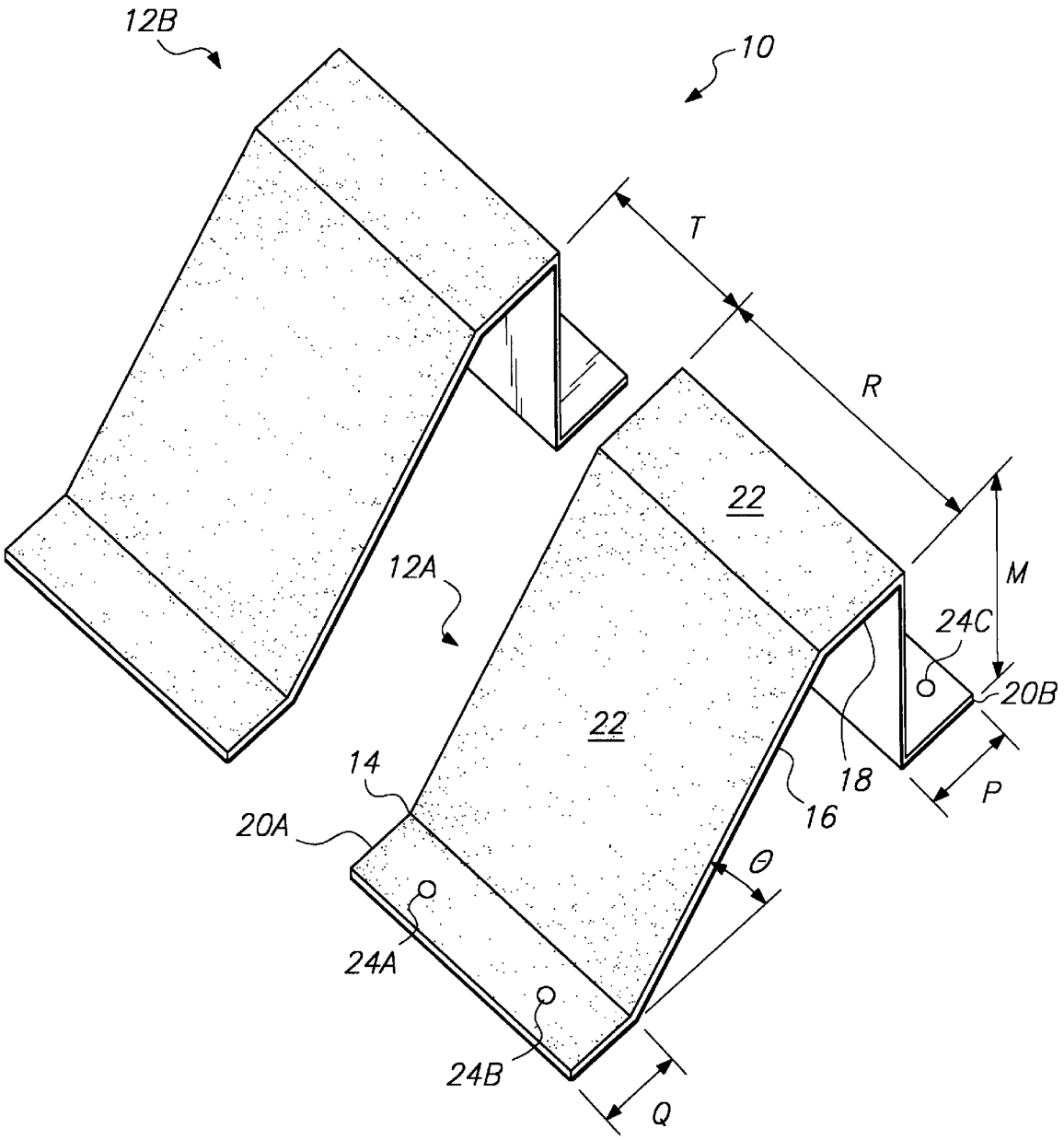
FIG. 1 depicts a pair of supports according to an embodiment of the invention.

The invention is described with respect to certain configurations and dimensions. A person skilled in the art will recognize that modifications to the invention can be made while staying within the scope of the invention.

A first embodiment is described with reference to FIGS. 1 and 2A–D. A lower body exercise apparatus 10 includes a plurality of supports 12A and 12B. For purposes of this description, supports 12A and 12B are substantially identical, although they need not be. Therefore, a dimensional description of support 12A also pertains to support 12B. Each support is constructed from a steel plate base 14, which includes an inclined support surface 16, an upper horizontal surface 18 and horizontal securement flanges 20A and 20B. Inclined support surface 16, upper horizontal surface 18 and securement flange 20A are substantially covered by a high friction non-slip surface layer 22 to improve traction and prevent slipping of the user's feet during use. The high friction surface can be safety paper, for example, which is essentially rough sand paper with an adhesive backing. Alternatively, the high friction surface can include grooves cut into or raised upon inclined surface 16. In one aspect of the invention securement flanges 20A and 20B have holes 24A–D drilled therethrough which may be used to bolt support 12A to a foundation and thus secure it firmly in place, again to eliminate slipping during use. Alternatively, a high friction non-slip surface can also be applied to the bottom portions of the securement flanges 20A and 20B to eliminate slippage during use.

Figure 2A:
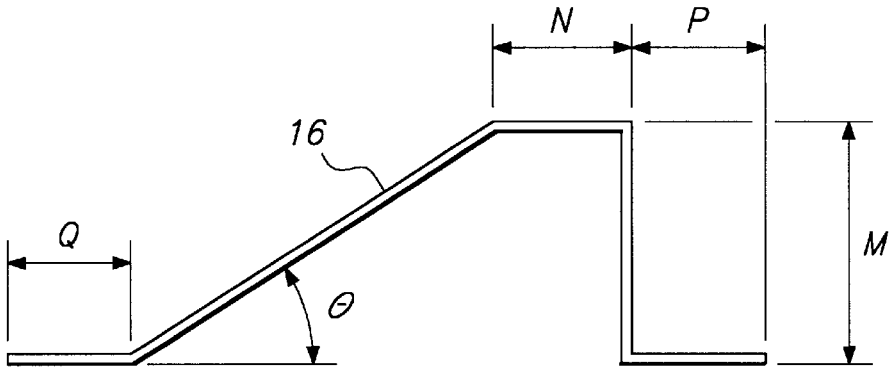
FIGS. 2A–D depict a side view, front view, back view and top view of a support according to an embodiment of the invention.
Figure 2B:
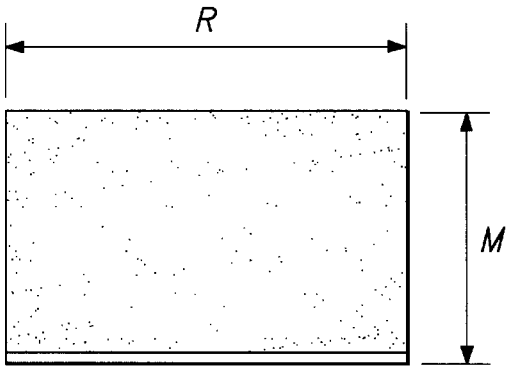
Figure 2C:
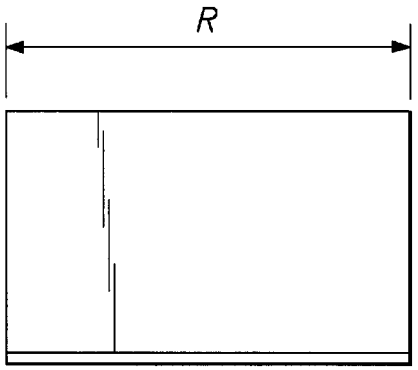
Figure 2D:
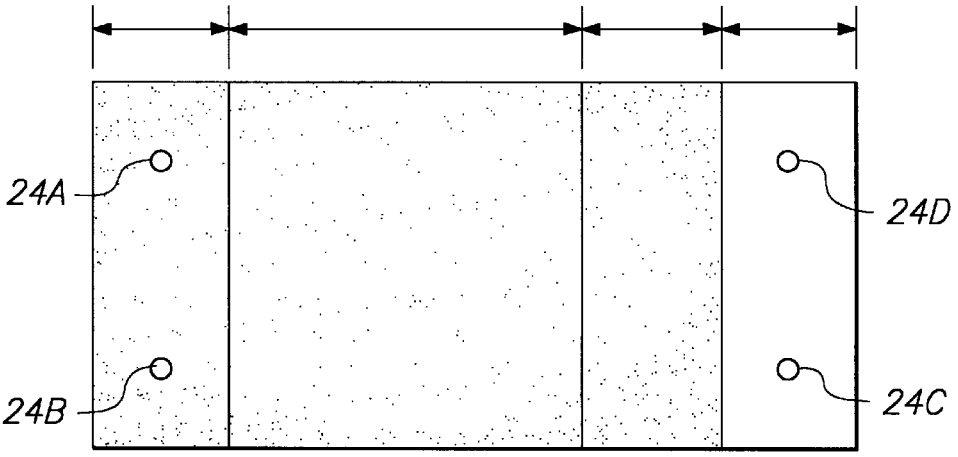

FIGS. 2A–D depict a side view, front view, back view and top view of support 12A. A side view of support 12A is illustrated in FIG. 2A. This side view shows an angle θ formed between inclined surface 16 and a horizontal surface such as a floor. In the embodiment shown, angle θ is 35°. In general, angle θ should be between approximately 20° and 55°, more preferably between approximately 30° and 40°, and most preferably approximately 35°. While the dimensions will depend on the angle used and the comfort of the user, examples of dimensions are given as follows: M is approximately 6 to 8 inches; N is approximately 3 inches; P is approximately 3 inches; Q is approximately 3 inches and R is approximately 9 inches. With reference to FIG. 1, dimension T can range from 0 inches to 24 inches or more depending on the desire of the user.

To use the exercise apparatus, the user places one foot on each support 12A and 12B. To perform a lower body muscle exercise, the user places the foot downward on the inclined surface 16 so that the toes are near to the floor and the heel is near to the upper horizontal surface 18. In some cases, the user may wish to actually seat the heel on the upper horizontal surface 18, which is large enough for such purpose. With the feet positioned in this manner the user may then perform squat exercises, either with or without weights, to exercise the leg muscles. This exercises the leg muscles more fully than possible with known lower body exercise apparatus.

Another exercise that can be performed on the apparatus is to place the foot upward on the inclined surface 16 so that the heel is near to the floor and the toes are near to the upper horizontal surface 18. With the feet positioned in this manner, stretching exercises can be performed either with or without weights. This exercise is a good complement to the squat exercises described above.

Figure 3:
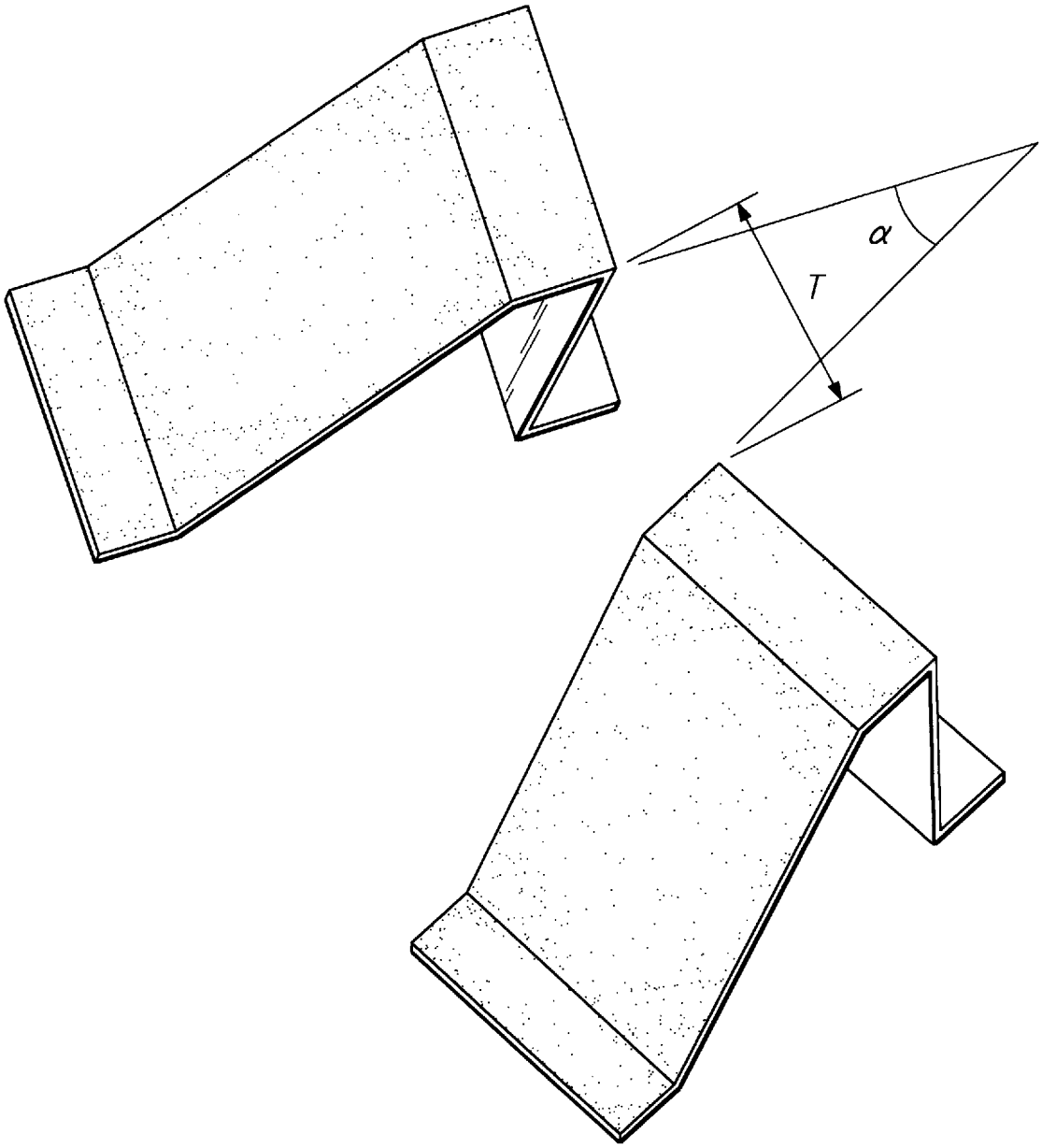
FIG. 3 depicts a pair of supports according to another embodiment of the invention.

Since many users have different desires for positioning their feet during exercise, the invention permits the user to custom configure the supports 12A and 12B for each user. Referring to FIG. 3, supports 12A and 12B can be positioned at a distance T from one another and at an angle a with respect to one another. By positioning the supports in this manner, the user can configure the supports into a comfortable position. For example, T can be approximately 6 to 24 inches and a can be an angle of approximately 0° to 150°. The distance T and the angle a will determine which lower body muscles are exercised and these parameters may be customized by the user depending on the muscle group that the user wants to exercise.

Figure 4:
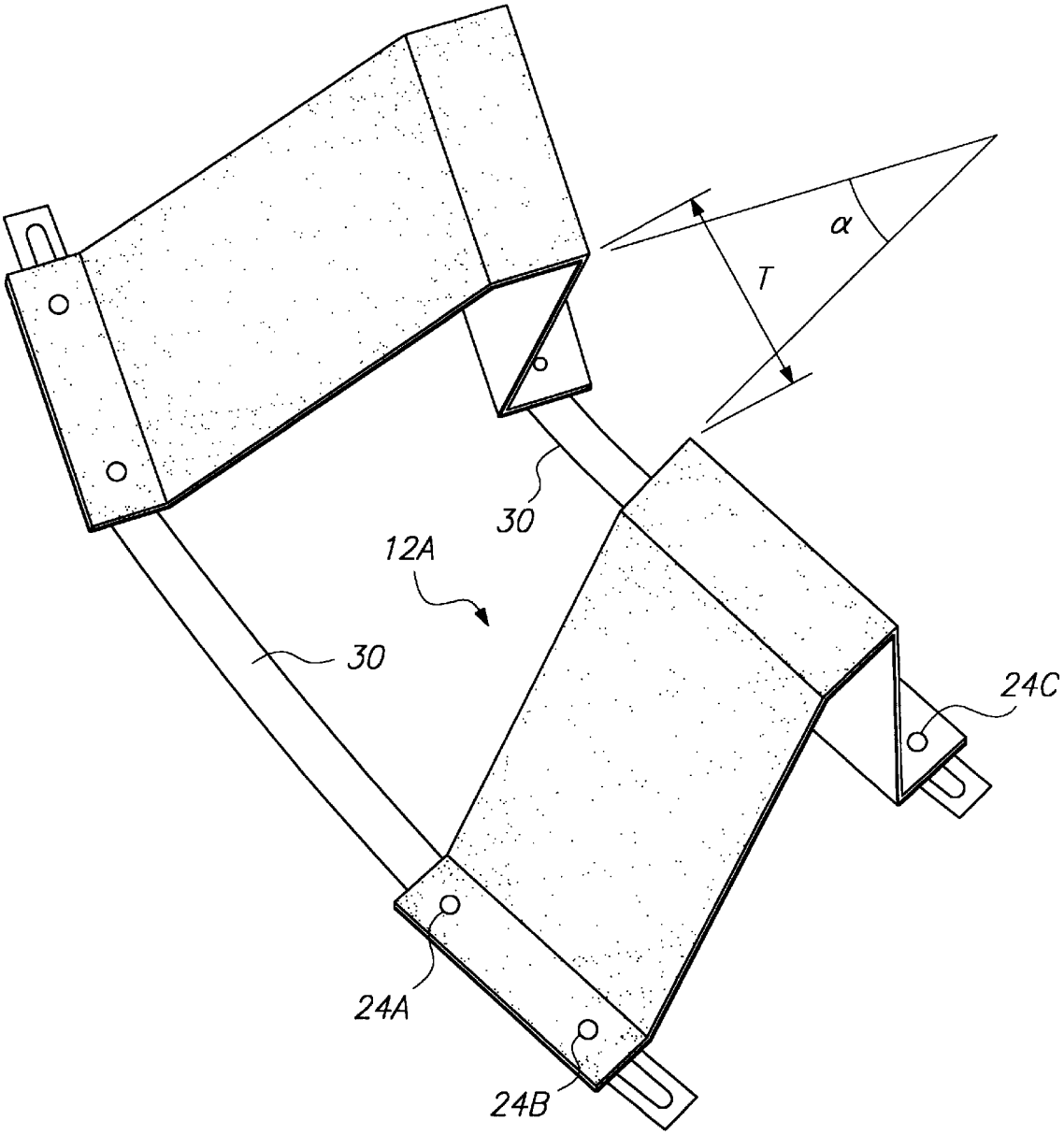
FIG. 4 depicts a pair of supports according to another embodiment of the invention.

Additionally, as shown in FIG. 4, a foundation 30 can be provided that attaches the supports 12A and 12B through holes 24A–D. The foundation 30 provides for the supports 12A and 12B to move in a predefined position and prevents the supports 12A and 12B from moving during the exercise. In some cases, foundation 30 includes a solid metal member that is bolted to each support 12A and 12B, but in other cases, foundation 30 can be a floor or other horizontal surface on which the supports 12A and 12B are either bolted to or set upon and held in place by gravity. In another aspect of the invention, the supports can be held in place on a foundation of earth by placing stakes though holes 24A–D.

Figure 5A:
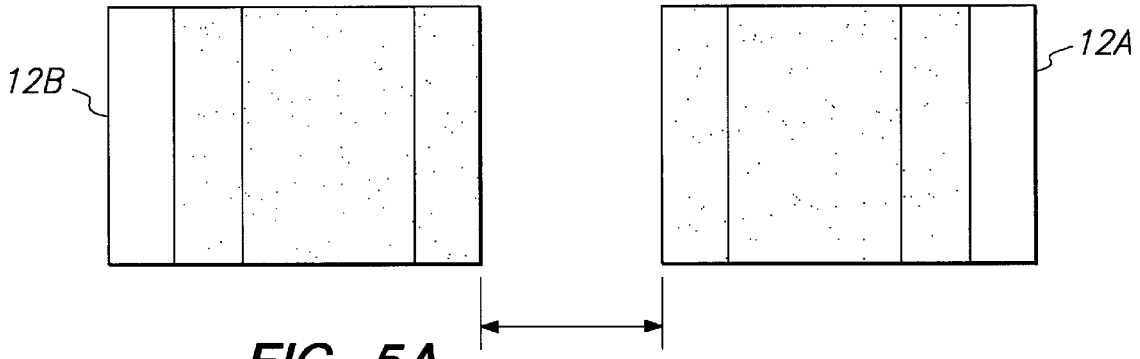
FIGS. 5A–D depict a pair of supports according to another embodiment of the invention.
Figure 5C:
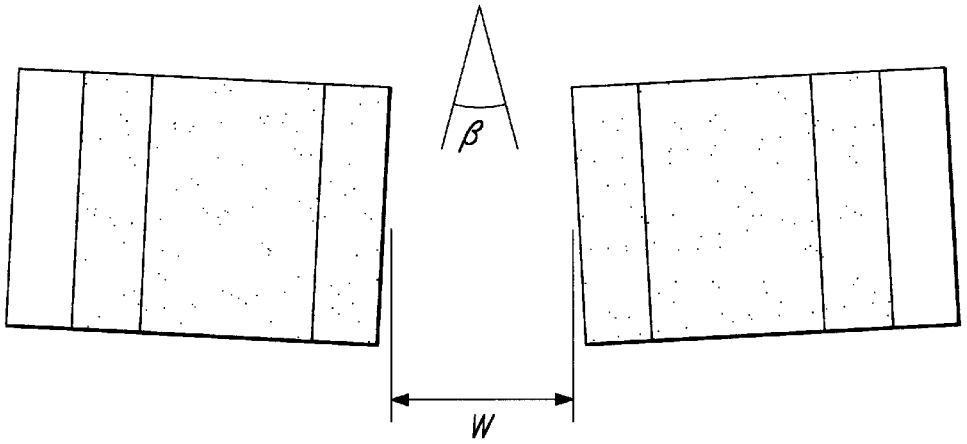
Figure 5B:
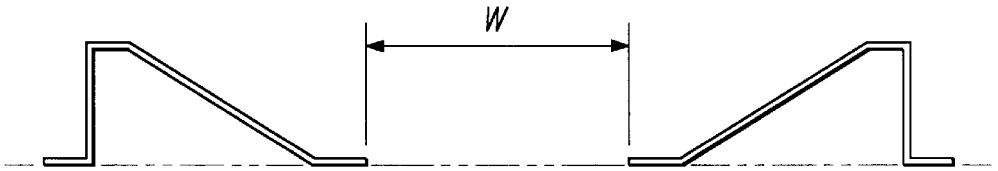

FIG. 5A shows another embodiment of the invention where the supports 12A and 12B are placed with the inclined surfaces facing one another as shown by the side view of FIG. 5B. In this embodiment, the supports 12A and 12B are provided to allow the user to exercise the leg and ankle muscles and to allow the user to perform agility exercises by shifting weight from one support to the other. In an advanced agility exercise, the user can even hop from one support to the other. The benefit to this exercise is to strengthen the leg and ankle muscles and to simulate action for sports such as hockey, speed skating, snow skiing or rollerblading where the players are required to push off from the side of their feet and to stop by placing force along the side of their feet. For this type of exercise, the supports are placed at a distance W from one another, such as approximately 18 to 24 inches or more.

Figure 5D:
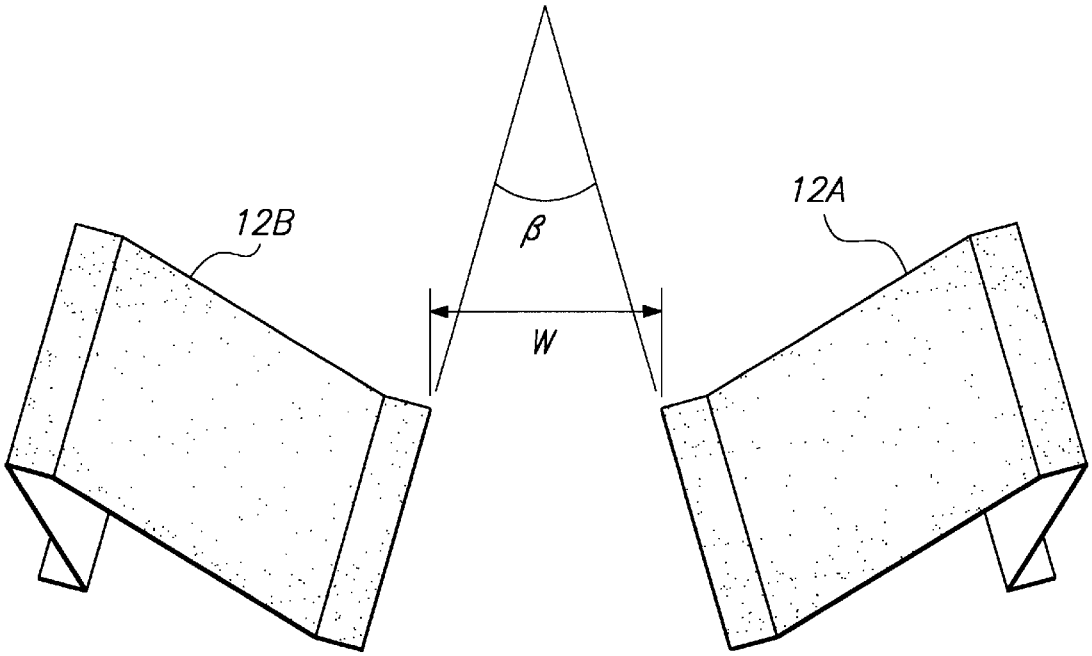

In some instances, the user may wish to angle the supports with respect to one another. FIG. SC shows the supports 12A and 12B positioned at an angle with respect to one another. In this aspect of the invention, for example, the angle β can range from approximately 0° to 20°, and preferably between 0° to 6°. This angle helps to simulate the true angle that a sports player experiences when the player pushes off from the side of the foot. FIG. 5D is an axonometric view of the supports 12A and 12B positioned as they would be to perform a lower body exercise.

Figure 6:
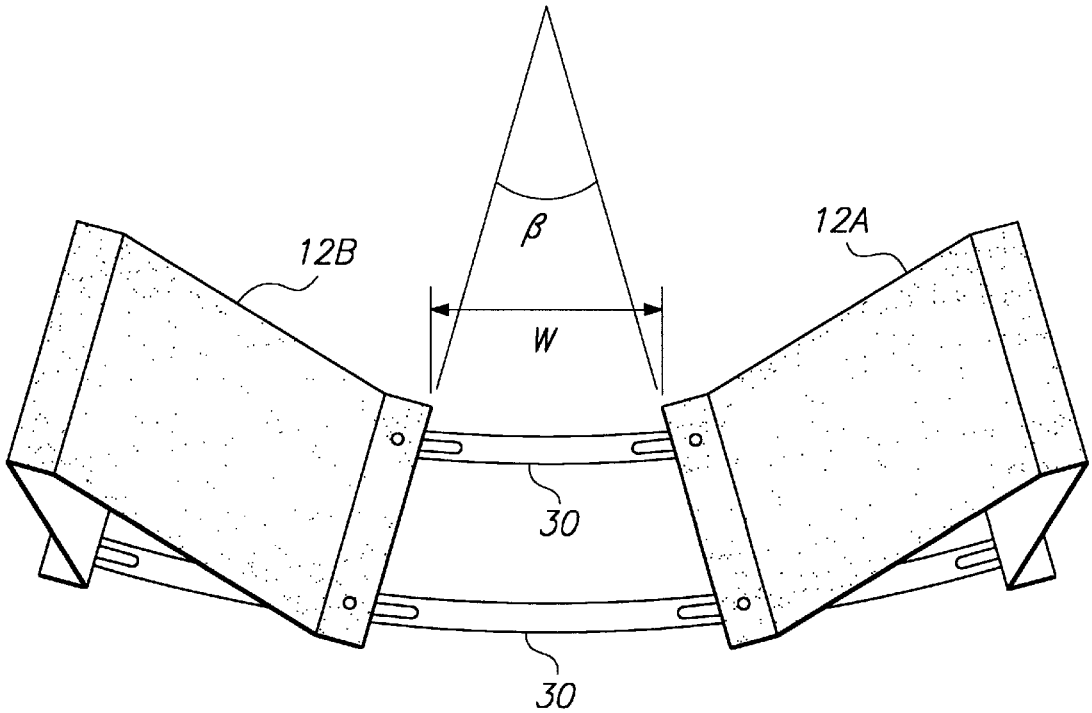
FIG. 6 depicts a pair of supports according to another embodiment of the invention.

FIG. 6 shows the supports 12A and 12B held together by a foundation 30. As in the previous embodiment, foundation 30 serves to hold supports 12A and 12B together so that they do not move with respect to one another during the exercise. Again, while foundation 30 can be a solid steel member, it can also be a floor or other horizontal support.

Figure 7A:
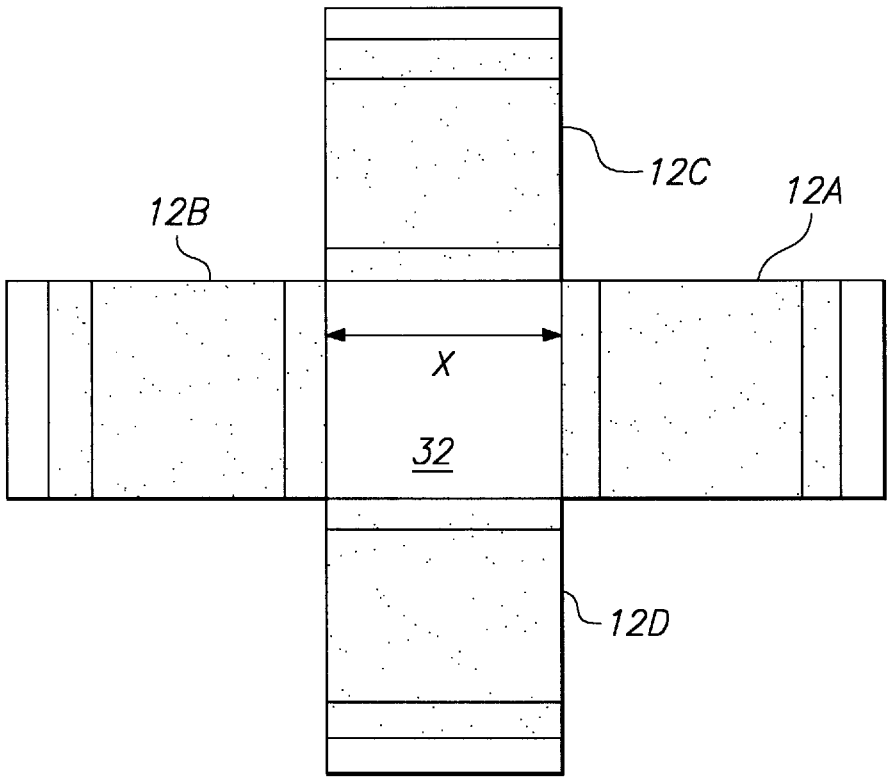
FIGS. 7A–C depict two pairs of supports according to another embodiment of the invention.
Figure 7B:
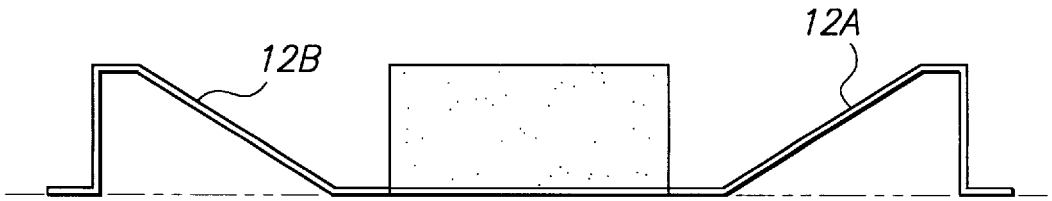
Figure 7C:
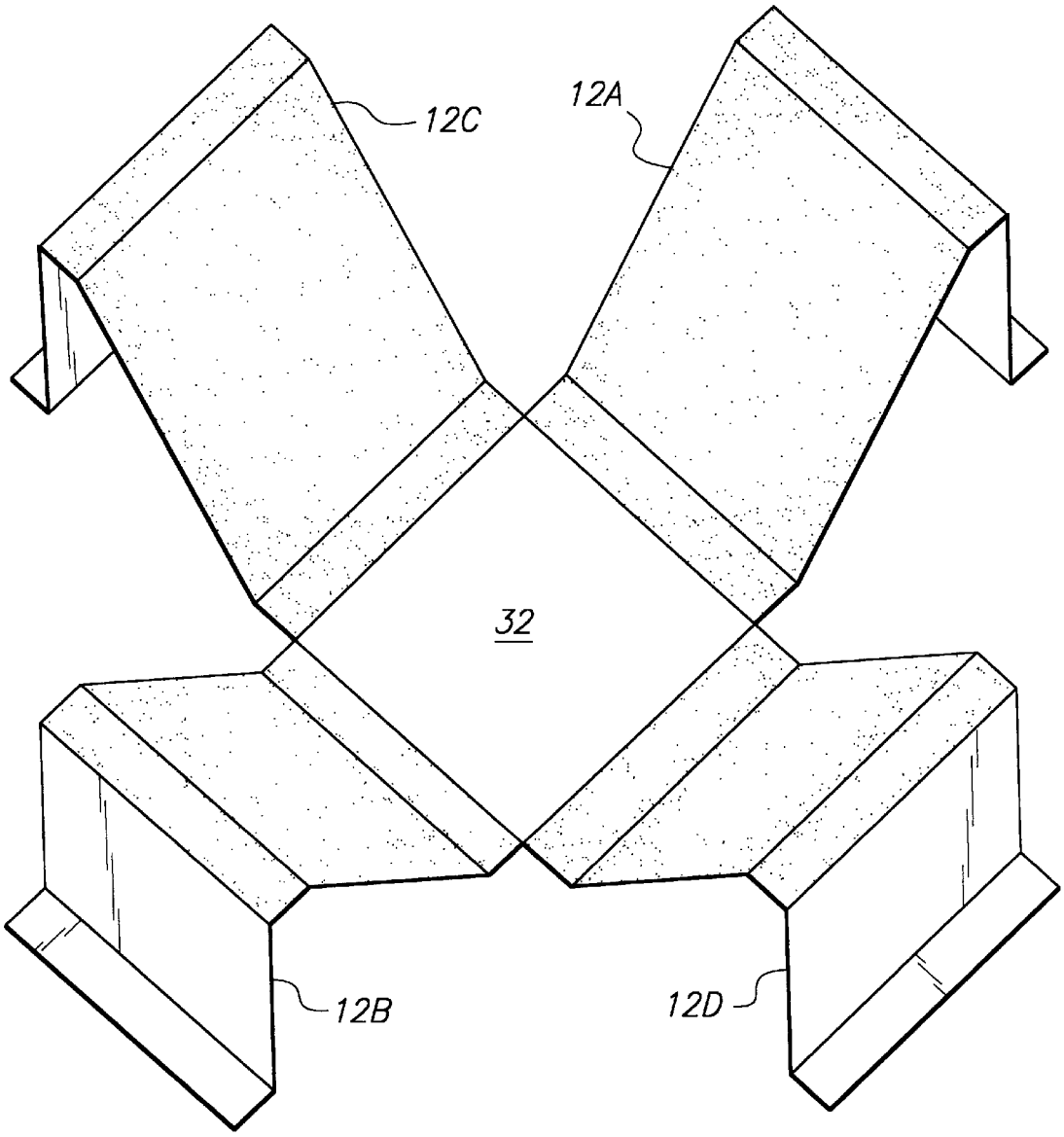

FIG. 7A depicts another embodiment of the invention where two pairs of supports are positioned with respect to one another to form substantially a rectangle, and in this case a square. Supports 12A and 12B are positioned opposite one another with their inclined surfaces facing one another. A second pair of supports 12C and 12D are positioned opposite one another with their inclined surfaces facing one another. The two pairs of supports are positioned to form a square 32 in the center. FIG. 7B shows a side view of supports 12A and 12B to show how their inclined surfaces are facing one another. FIG. 7C is another view of the supports 12A–D showing their arrangement. This arrangement is beneficial for exercising the leg and ankle muscles and for performing advanced agility exercises. For example, a user can place one foot in space 32 and can place one foot on support 12A and push off the inclined surface of support 12A. Then the user can rotate and place one foot on support 12C and push off the inclined surface of support 12C. This type of exercise is beneficial for baseball players who are required to push off a base bag to sprint from one base to another. This exercise strengthens the leg and ankle muscles and improves agility. In this example, the dimension X is approximately 18 to 24 inches. As in the previous embodiments, a foundation can be used to hold supports 12A–D together so that they do not move with respect to one another during the exercise. Again, while the foundation can be a solid steel member, it can also be a floor or other horizontal support.

CONCLUSION

The supports can be custom configured and positioned by the user to provide beneficial exercise for a variety of sports. Advantages of the invention include improved lower body muscle strength and improved agility.

Having disclosed exemplary embodiments and the best mode, modifications and variations may be made to the exemplary embodiments while remaining within the scope of the invention as defined by the following claims.

What is claimed is:

1. A lower body exercise apparatus, comprising:

a first base having a first securement flange configured to secure said first base to a horizontal surface, and a first inclined surface attached to and supported by said first base and extending upwardly from said first base where a lower portion of said first inclined surface is configured to accommodate a ball of a user's foot, said first inclined surface extending upwardly to a first upper horizontal surface of a size sufficient to accommodate a portion of the user's foot, said first upper horizontal surface also supported by said first base, said first inclined surface forming a first fixed angle from horizontal and having a rough high friction surface, wherein said first inclined surface is sufficiently rigid to support the user's full weight during an exercise while substantially maintaining said first fixed angle; and a second base having a second securement flange configured to secure said second base to a horizontal surface, and a second inclined surface attached to and supported by said second base and extending upwardly from said second base where a lower portion of said second inclined surface is configured to accommodate a ball of the user's foot, said second inclined surface extending upwardly to a second upper horizontal surface of a size sufficient to accommodate a portion of the user's foot, said second upper horizontal surface also supported by said second base, said second inclined surface forming a second fixed angle from horizontal and having a rough high friction surface, wherein said second inclined surface is sufficiently rigid to support the user's full weight during an exercise while substantially maintaining said second fixed angle;

a foundation coupled to said first securement flange and said second securement flange and configured to hold said first base and said second base in a fixed position with respect to one another; and wherein said first base and said second base are positioned at a distance from one another and having said first inclined surface and said second inclined surface substantially facing one another at an angle β of approximately 0° to 6° with respect to one another.

2. The lower body exercise apparatus of claim 1, wherein:

said first fixed angle and said second fixed angle are approximately 20° to 55° from horizontal.

3. The lower body exercise apparatus of claim 1, further comprising:

a third base positioned at an angle with reference to said first base and configured to support the fill weight of the user, and a third inclined surface attached to and supported by said third base and extending upwardly from said third base where a lower portion of said third inclined surface is configured to accommodate a ball of the user's foot, said third inclined surface extending upwardly to a third upper horizontal surface of a size sufficient to accommodate a portion of the user's foot, said third upper horizontal surface also supported by said third base, said third inclined surface forming a third fixed angle from horizontal and having a rough high friction surface, wherein said third inclined surface is sufficiently rigid to support the user's fill weight during an exercise while substantially maintaining said third fixed angle; and a fourth base positioned at an angle with reference to said first base and configured to support the full weight of the user, and a fourth inclined surface attached to and supported by said fourth base and extending upwardly from said fourth base where a lower portion of said fourth inclined surface is configured to accommodate a ball of the user's foot, said fourth inclined surface extending upwardly to a fourth upper horizontal surface of a size sufficient to accommodate a portion of the user's foot, said fourth upper horizontal surface also supported by said fourth base, said fourth inclined surface forming a fourth fixed angle from horizontal and having a rough high friction surface, wherein said fourth inclined surface is sufficiently rigid to support the user's full weight during an exercise while substantially maintaining said fourth fixed angles; and wherein said third base and said fourth base are positioned at a distance from one another and having said third inclined surface and said fourth inclined surface substantially facing one another.

4. The lower body exercise apparatus of claim 3, wherein:

said first fixed angle, said second fixed angle, said third fixed angle and said fourth fixed angle are approximately 20° to 55° from horizontal.

5. The lower body exercise apparatus of claim 4, wherein:

said first base, second base, third base and fourth base are arranged substantially in a rectangle on a horizontal surface.

6. The lower body exercise apparatus of claim 3, wherein:

said first base, second base, third base and fourth base are arranged substantially in a rectangle on a horizontal surface.

* * * * *